US006820607B1

(12) United States Patent
Terry

(10) Patent No.: US 6,820,607 B1
(45) Date of Patent: Nov. 23, 2004

(54) ARROW REST FOR AN ARCHERY BOW

(76) Inventor: Edgell Terry, 1115 Shady La., Rome City, IN (US) 46784

( * ) Notice: Subject to any disclaimer, the term of this patent is extended or adjusted under 35 U.S.C. 154(b) by 0 days.

(21) Appl. No.: 10/614,608

(22) Filed: Jul. 7, 2003

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,287,868 A * 9/1981 Schiff ..... 124/44.5
4,344,409 A * 8/1982 Barner ..... 124/24.1
4,803,971 A * 2/1989 Fletcher ..... 124/44.5
4,907,566 A * 3/1990 Klein ..... 124/44.5
4,953,521 A * 9/1990 Troncoso et al. ..... 124/24.1
5,150,700 A * 9/1992 Troncoso ..... 124/44.5
5,235,958 A * 8/1993 Laffin ..... 124/44.5
6,595,195 B1 * 7/2003 Barner et al. ..... 124/44.5

* cited by examiner

*Primary Examiner*—John A. Ricci
(74) *Attorney, Agent, or Firm*—Taylor & Aust, P.C.

(57) ABSTRACT

An archery bow includes a riser, a pair of flexible limbs extending oppositely from the riser, and an arrow rest. Each limb has a distal end. The arrow rest is mounted to the riser and defines a trajectory path for an arrow. The arrow rest includes an arrow rest platform, a first sear associated with the arrow rest platform, and a second sear selectively engageable with the first sear. The first sear and second sear are automatically disengaged upon application of an impulse in a direction generally parallel to the trajectory path of the arrow.

8 Claims, 8 Drawing Sheets

ARROW REST FOR AN ARCHERY BOW

BACKGROUND OF THE INVENTION

1. Field of the Invention

The present invention relates to archery equipment, and, more particularly, to arrow rests for archery equipment.

2. Description of the Related Art

Devices are known which provide improved accuracy for individuals target shooting and hunting with archery equipment. For example, bow sights have long been used to provide improved accuracy of an archery bow. A rear sight may be in the form of a bow string mounted peep sight having a small hole which is aligned with a forward sight pin mounted on the bow riser for substantially increasing the accuracy of the bow. As a further example, the front sight may be in the form of multiple, vertically aligned horizontal pins mounted in a frame to protect the pins. These multi-pin sights have proliferated in the last few years, especially in the hunting arena, where the distance to a target can vary as much as from 10–60 yards. Optical lenses defining a scope sight may also be used to provide improved accuracy. Yet still, it is also known to use a laser sight which is aligned at a fixed position relative to the riser of the bow to project a laser beam and ultimately a red dot onto a target.

Arrow rests of various configurations are also known for improving the accuracy of an archery bow. An arrow rest generally includes an arrow rest platform for supporting the arrow during drawing and shooting of the bow. The fletchings of the arrow are preferably oriented so as to not impact with the arrow rest platform of the arrow rest upon shooting of the bow. The arrow rest platform may be in the form of a plate or leaf with a notch formed in the distal end for supporting the arrow, or a pair of spaced apart pins which support the underside of the arrow. Other types of arrow rest platforms are also possible.

It is also known to move the arrow rest platform of an arrow rest between a raised support position and a lowered position upon shooting of the bow such that the arrow rest platform does not interfere with the free flight of the arrow. The arrow rest platform is biased to a lowered position using a spring arrangement. A rubber tube is coupled at one end with the arrow rest platform and at the other end with the bow string. Upon drawing the bow string, the rubber tube rotates the arrow rest platform to a raised position. Upon release of the bow string, the rubber tube moves from a stretched position to a relaxed position which allows the arrow rest platform to fall to the lowered position. In theory, moving the arrow rest platform to a lowered position which does not interfere with the free flight of the arrow would provide improved accuracy. However, the mechanics of this known type of design for moving the arrow rest platform to a lowered position has proved to be cumbersome and somewhat un reliable.

What is needed in the art is an arrow rest with an arrow rest platform which may be reliably moved between a raised support position and a lowered position upon shooting of an archery bow to provide improved accuracy of the archery bow.

SUMMARY OF THE INVENTION

The present invention provides an arrow rest for an archery bow including an arrow rest platform which is automatically moved to a lowered position upon shooting the bow such that the arrow rest platform does not interfere with the free flight of the arrow.

The invention comprises, in one form thereof, an archery bow including a riser, a pair of flexible limbs extending oppositely from the riser, and an arrow rest. Each limb has a distal end. The arrow rest is mounted to the riser and defines a trajectory path for an arrow. The arrow rest includes an arrow rest platform, a first sear associated with the arrow rest platform, and a second sear selectively engagable with the first sear. The first sear and second sear are automatically disengaged upon application of an impulse in a direction generally parallel to the trajectory path of the arrow.

An advantage of the present invention is that the arrow rest platform is automatically accelerated to a lowered position upon shooting of the bow such that it does not interfere with the free flight of the arrow.

Another advantage is that an impulse received along a direction of the trajectory path of the arrow automatically disengages the first and second sears, while other extraneous forces or impulses received by the bow in other directions do not usually result in disengagement of the first and second sears.

Yet another advantage is that the actuator which moves the second sear to the disengaged position may be configured as a rotary actuator, linear actuator, or other suitable actuator.

Yet another advantage is that the arrow support platform may be configured as a plate, pair of pins, or other suitable arrow rest platform, depending upon the particular configuration.

Still another advantage is that the acceleration rate of the arrow rest platform between the raised support position and the lowered position may be adjusted depending upon the characteristics and attachment locations of the spring.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplification is not to be construed as limiting the scope of the invention in any manner.

DETAILED DESCRIPTION OF THE INVENTION

Figure 1:
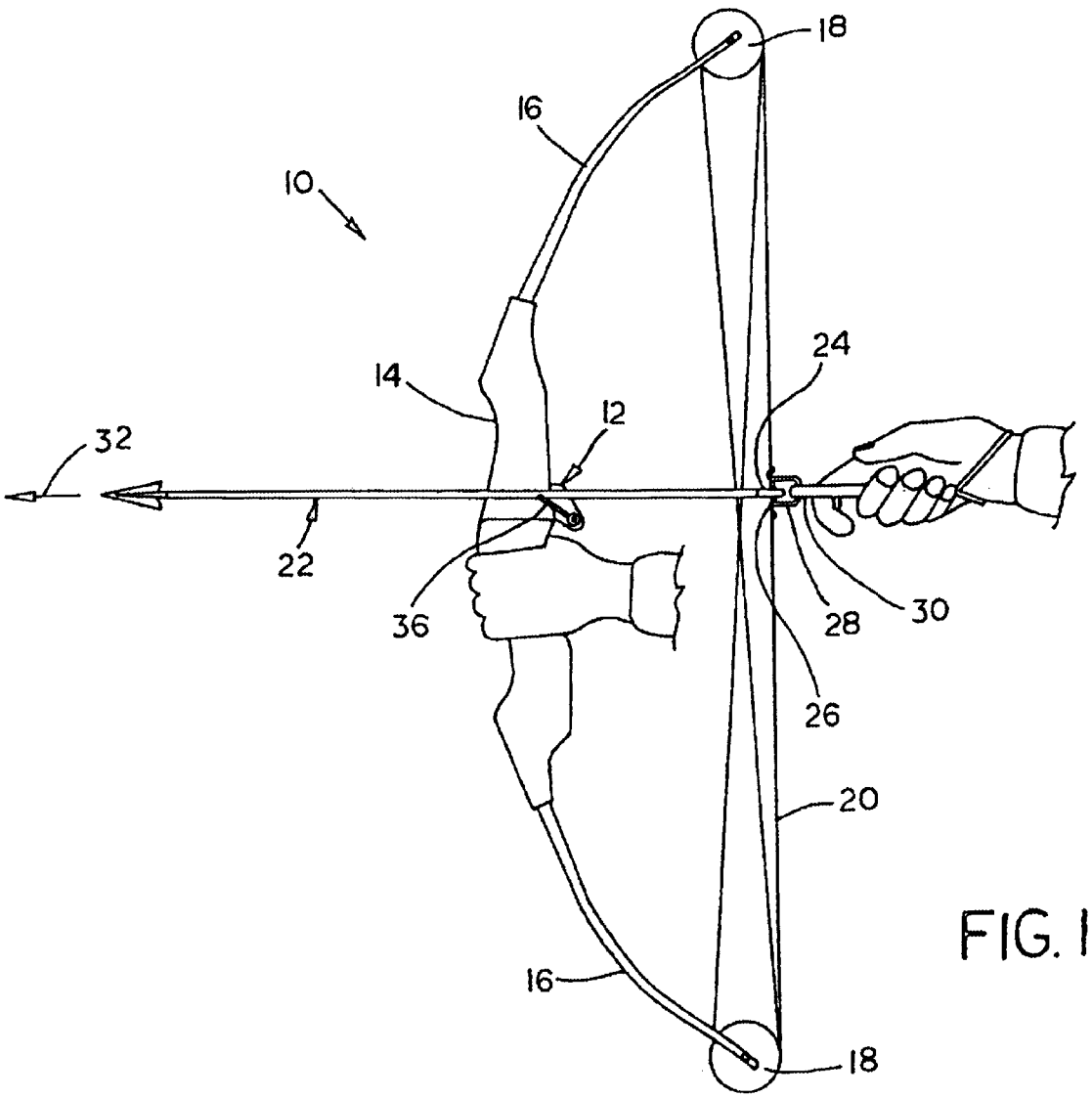
FIG. 1 is a side view of an archery bow of the present invention with the arrow rest platform in a raised support position, an arrow engaged with the bow string, and a hand release engaged with the nock set.

Referring now to the drawings, and more particularly to FIG. 1, there is shown an embodiment of an archery bow 10, incorporating an embodiment of an arrow rest 12 of the present invention.

In the embodiment shown, bow 10 is a compound bow, but may be differently configured depending upon the application. For example, bow 10 may be a recurve or other type of bow. Bow 10 includes a riser 14 and a pair of flexible limbs 16 extending oppositely from riser 14. At the distal end of each limb 16 is a single rotating member 18, such as a pulley (as shown), or a cam wheel (not shown). At least one string 20 wraps around rotating members 18 and biases limbs 16 to a preloaded state.

Arrow rest 12 is coupled with riser 14 and supports an arrow 22. Arrow 22 has a rear end with a nock 24 which is engaged with a nock location 26 on string 20. A nock set 28 is engaged by a hand release 30 during use. Arrow 22 carried by arrow rest 12 defines a trajectory plane (not numbered) associated with the trajectory path 32 of arrow 22. It will be appreciated that bow string 20 also lies within the trajectory plane of arrow 22. The trajectory plane may be adjusted somewhat by laterally adjusting arrow rest 12.

Referring conjunctively to FIGS. 1, 4, 6 and 8, the structure of arrow rest 12 will be described in more detail. Thereafter, the operation of arrow rest 12 will be described with reference to FIGS. 1–7. Arrow rest 12 includes a support body 34, arrow rest platform 36, first sear 38, second sear 40 and resilient biasing device 42. Support body 34 is mounted to riser 14 using an adjustable slot 44 and screw 46.

Arrow rest platform 36 is movable between a raised support position (FIG. 5) supporting arrow 22, and a lowered position (FIG. 7) allowing free flight of arrow 22. Arrow rest platform 36 is shown having a plate or leaf shaped configuration with a notch in the distal end for supporting arrow 22. However, it will be appreciated that arrow rest platform 36 may be differently configured, such as a pair of pins with spaced apart distal ends supporting arrow 22, or other suitable configuration. Set screw 48 holds arrow rest platform 36 in place within a slot formed in an end of pivot arm 50.

Pivot arm 50 extends through a transverse hole formed in support body 34 at an end generally opposite from adjustable slot 44. Hole 52 is sized with a diameter slightly larger than the outside diameter of pivot arm 50 such that pivot arm 50 is free to rotate within hole 52. A locking collar 54 with corresponding set screw 56 maintain the longitudinal position of pivot arm 50 on one side of support body 34. First sear 38 and corresponding set screw 58 maintain the longitudinal position of pivot arm 50 on the opposite side of support body 34.

Second sear 40 is carried by a rotary actuator which is pivotally coupled with support body 34. The rotary actuator includes a hub 60 coupled with a pendulum arm 62. Second sear 40 is coupled with pendulum arm 62 at an end opposite from hub 60. Hub 60 includes a hole 64 through which a screw 66 extends. Screw 66 is threadingly engaged with support body 34 and has a diameter slightly smaller than the inside diameter of hole 64 such that hub 60 is free to pivot about screw 66. Screw 66 may be formed with a shoulder or the like to limit the extent to which it may be screwed into the corresponding opening in support body 34.

First sear 38 includes a shoulder 68, and second sear 40 includes a mating shoulder 70. Shoulders 68 and 70 mate with each other when first sear 38 and second sear 40 are in the engaged position.

Resilient biasing device 42 is in the form of a spring in the embodiment shown. Spring 42 maintains first sear 38 and second sear 40 in an engaged position and in turn maintains arrow rest platform 36 in a raised support position, when first sear 38 and second sear 40 are engaged with each other. One end of spring 42 is coupled with set screw 58 and an opposite end of spring 42 is coupled with pendulum arm 62. The exact position and manner of attachment of spring 42 with pendulum arm 62 and/or first sear 38 may vary, depending upon the application. Moreover, sprint 42 may be a tension spring, compression spring, leaf spring, etc.

Figure 2:
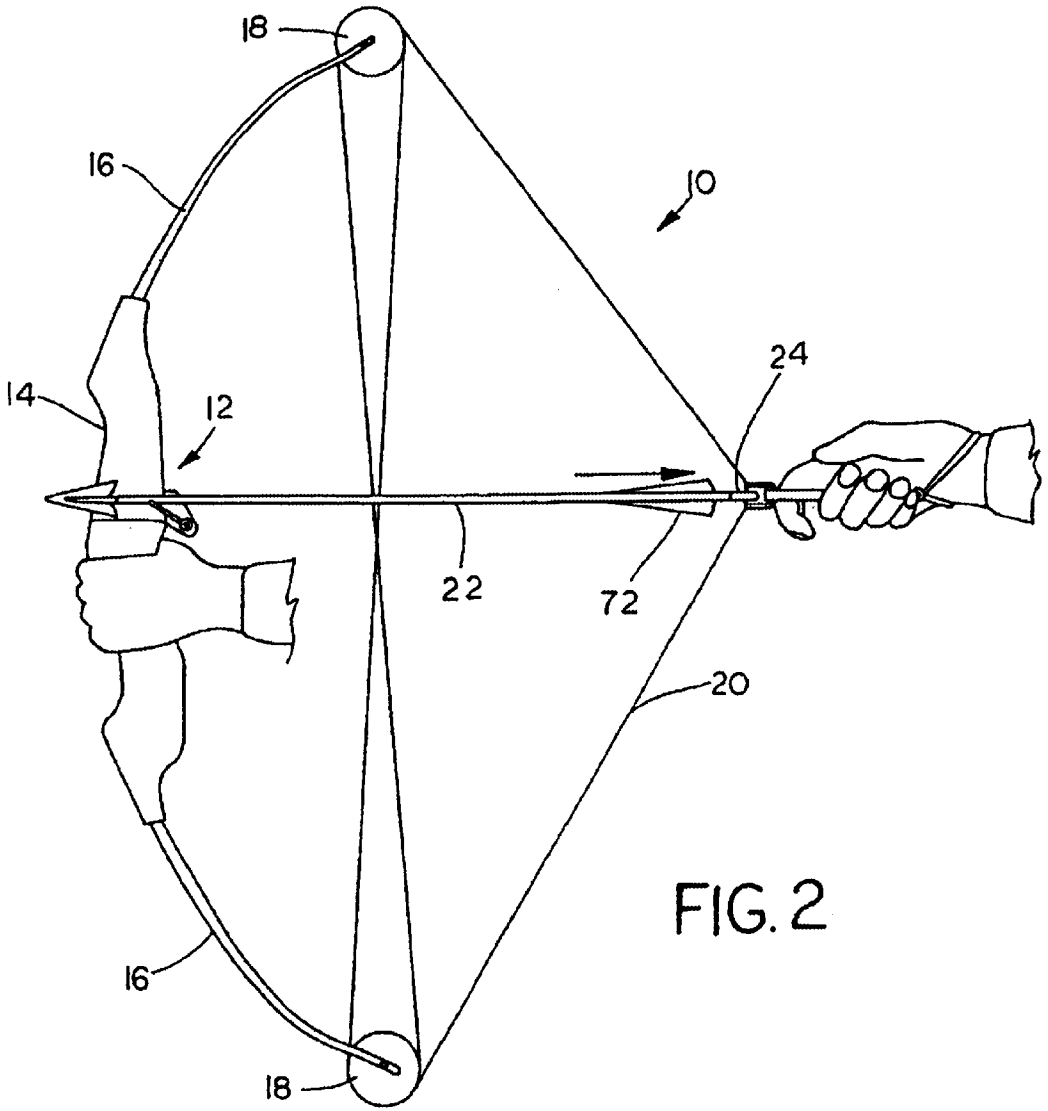
FIG. 2 is a side view of the archery bow of FIG. 1 when in the drawn position.
Figure 3:
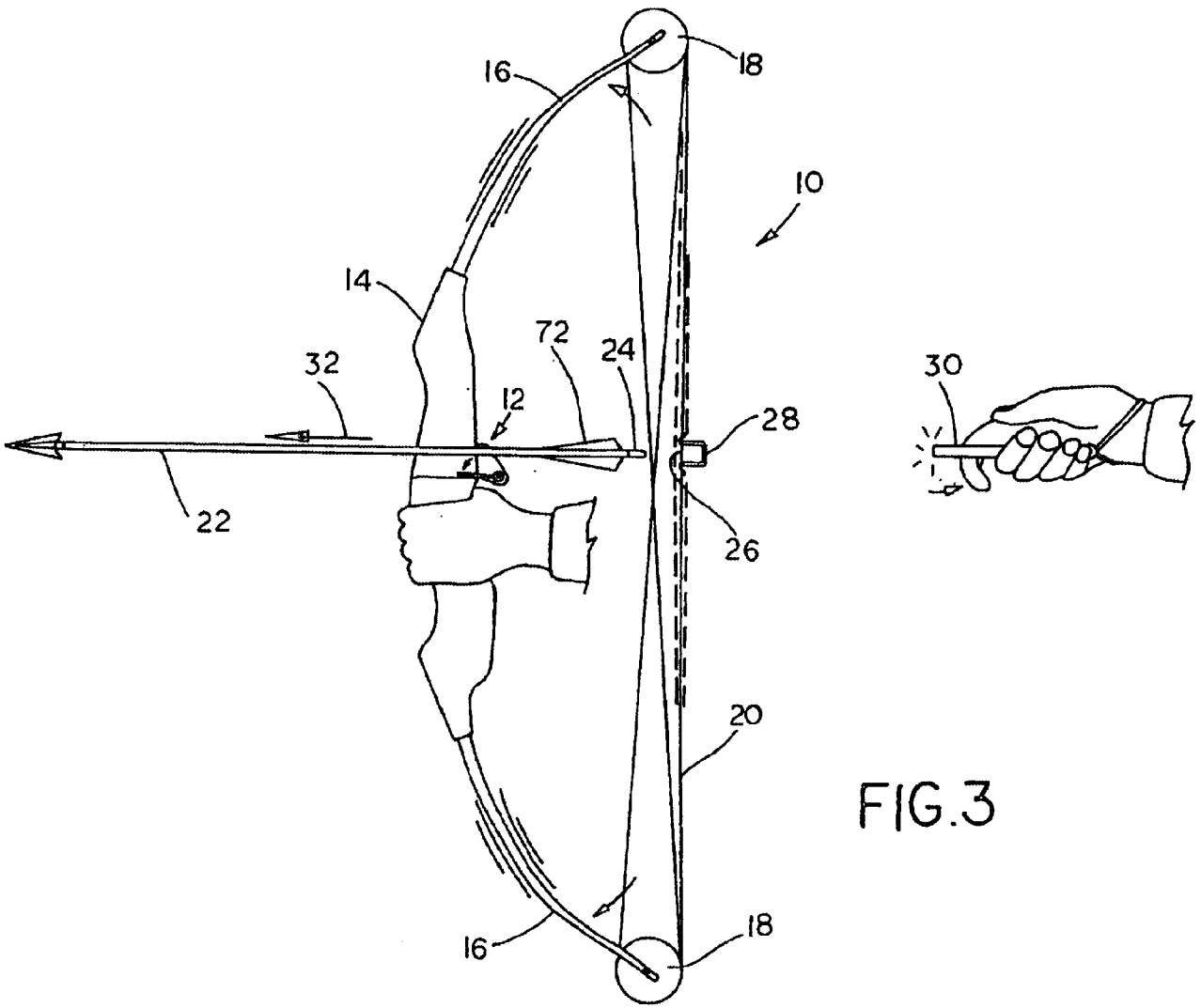
FIG. 3 is a side view of the archery bow of FIG. 1 upon release of the string from the hand release.
Figure 4:
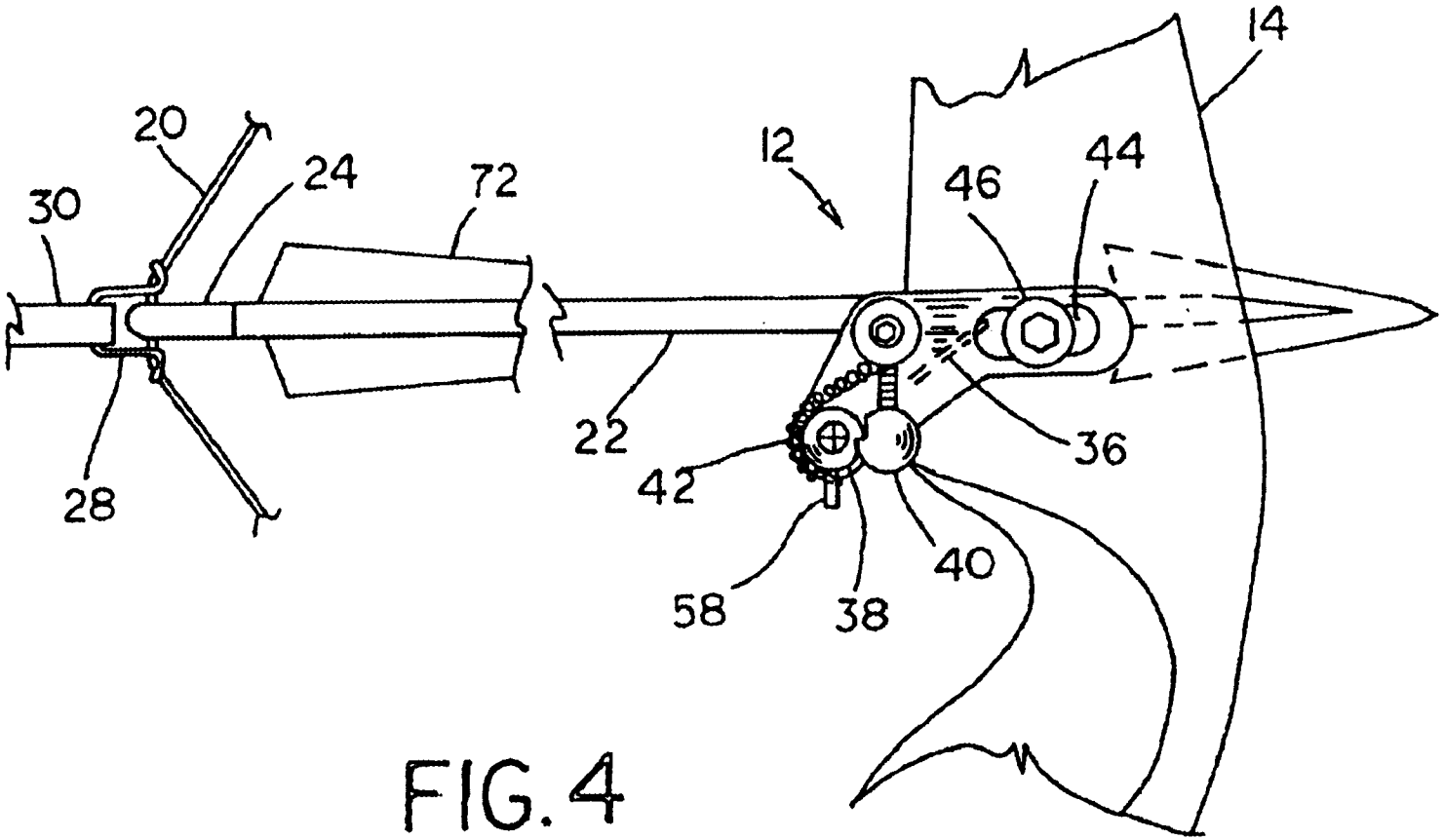
FIGS. 4 and 5 are opposite side views of the arrow rest when the arrow rest platform is in a raised support position.
Figure 5:
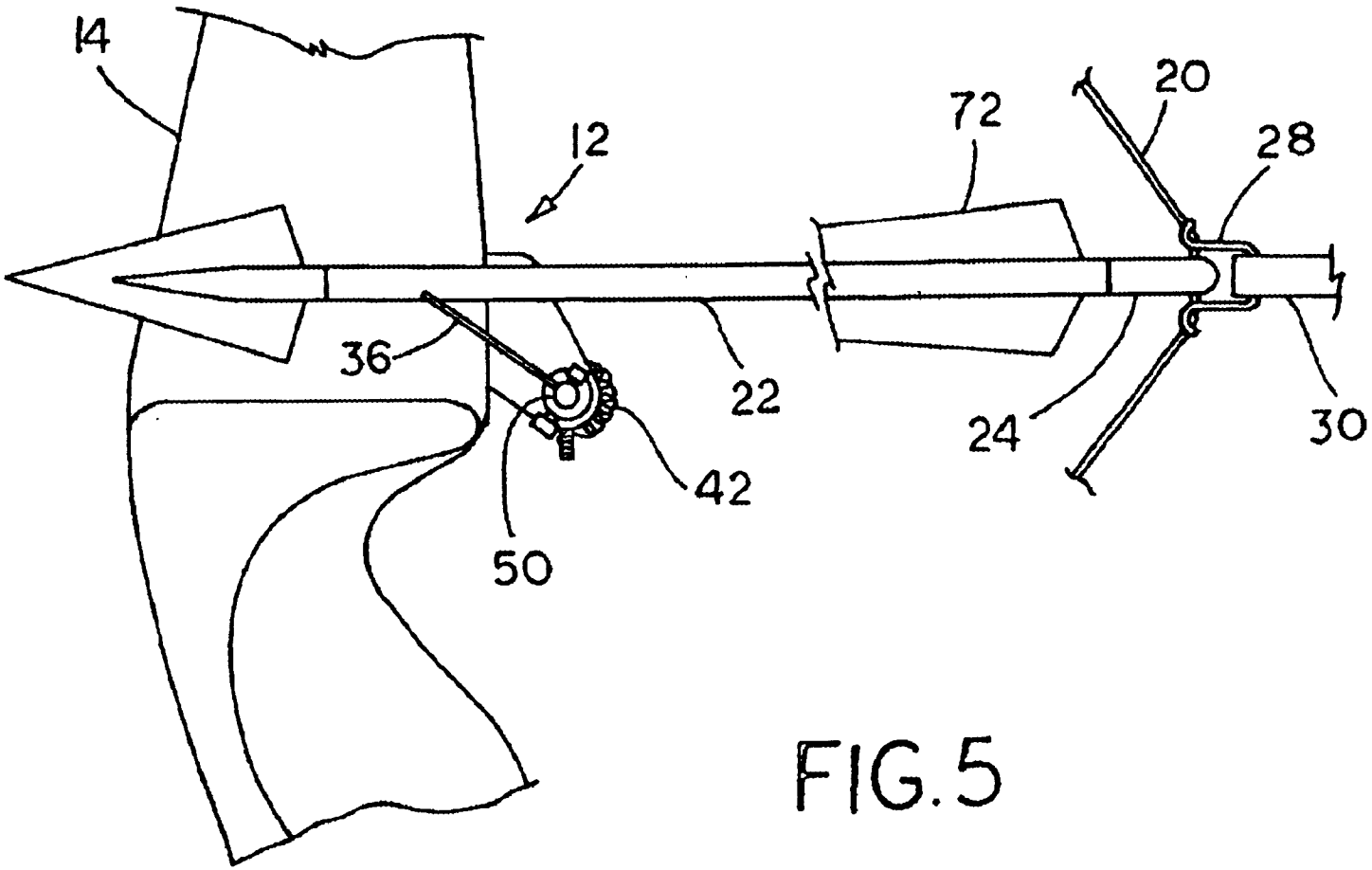
Figure 6:
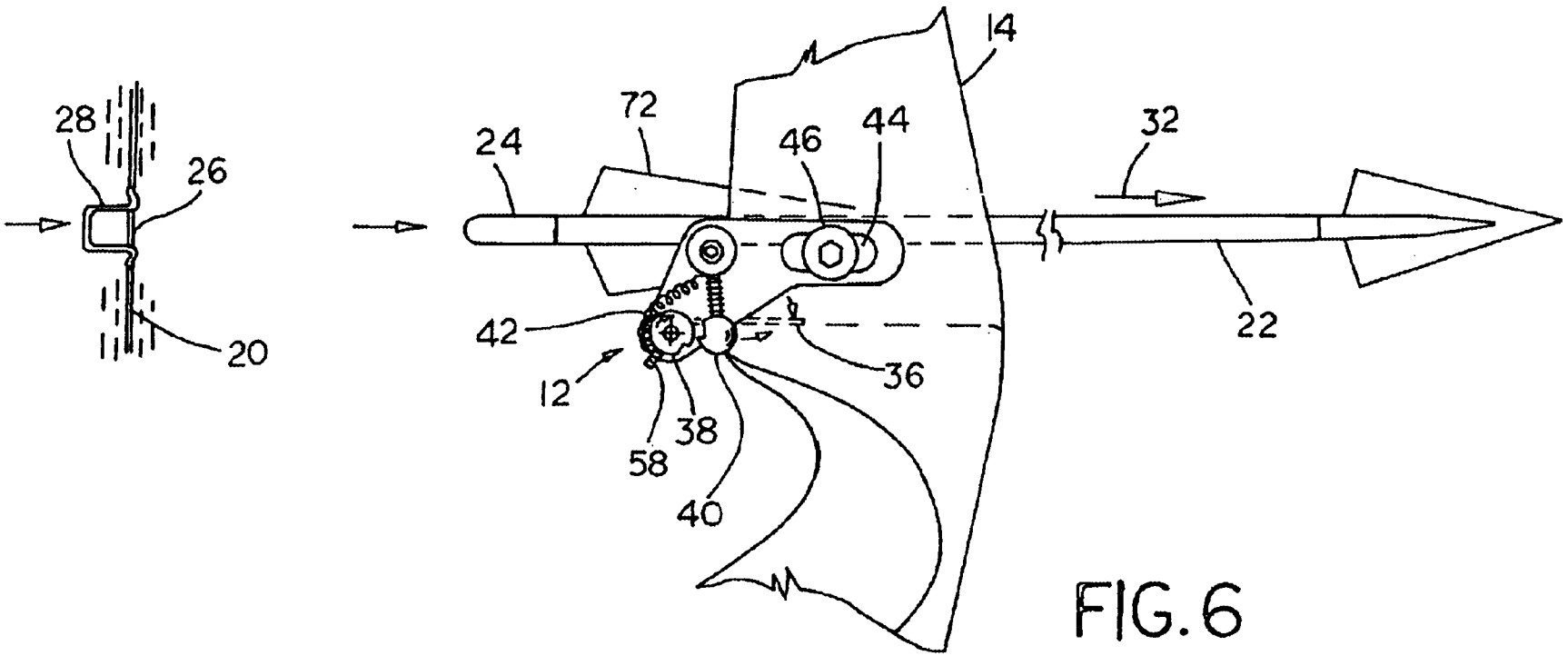
FIGS. 6 and 7 are opposite side views of the arrow rest when the arrow rest platform is in a lowered position.
Figure 7:
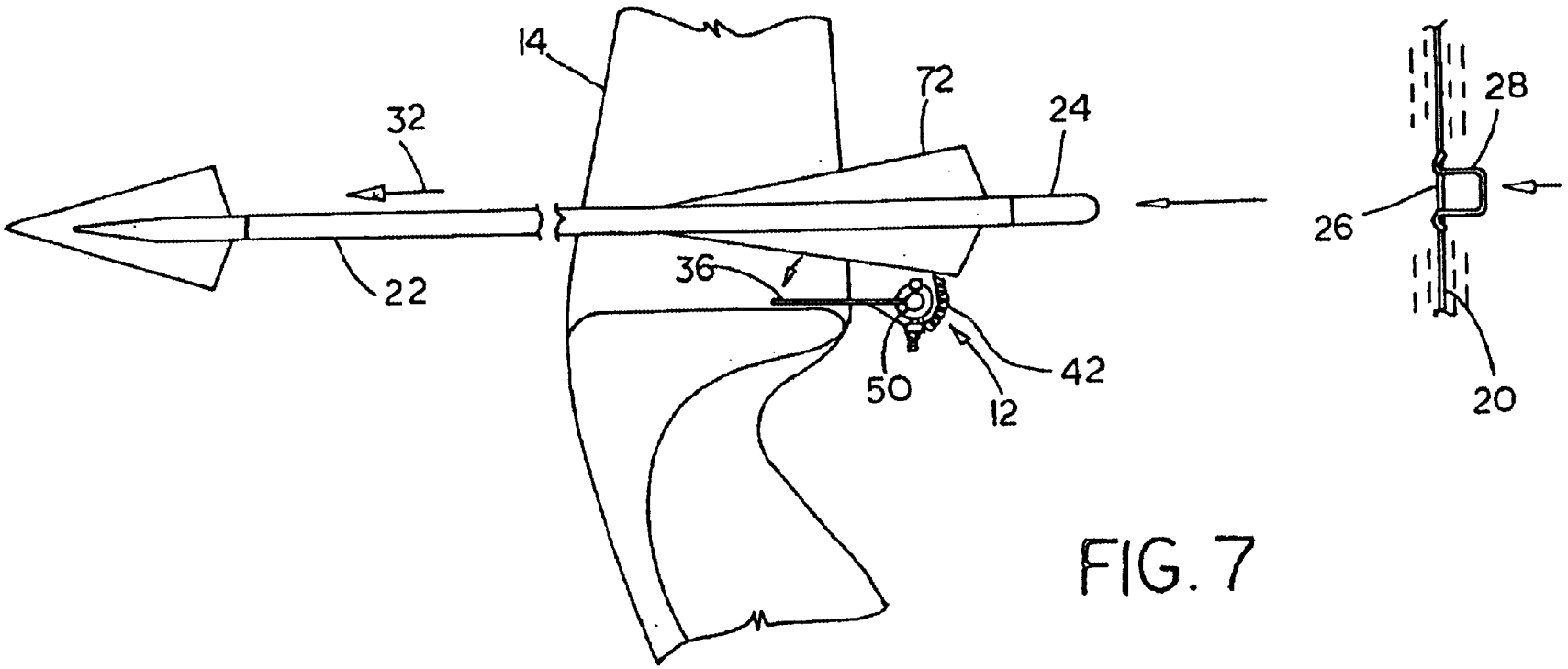
Figure 8:
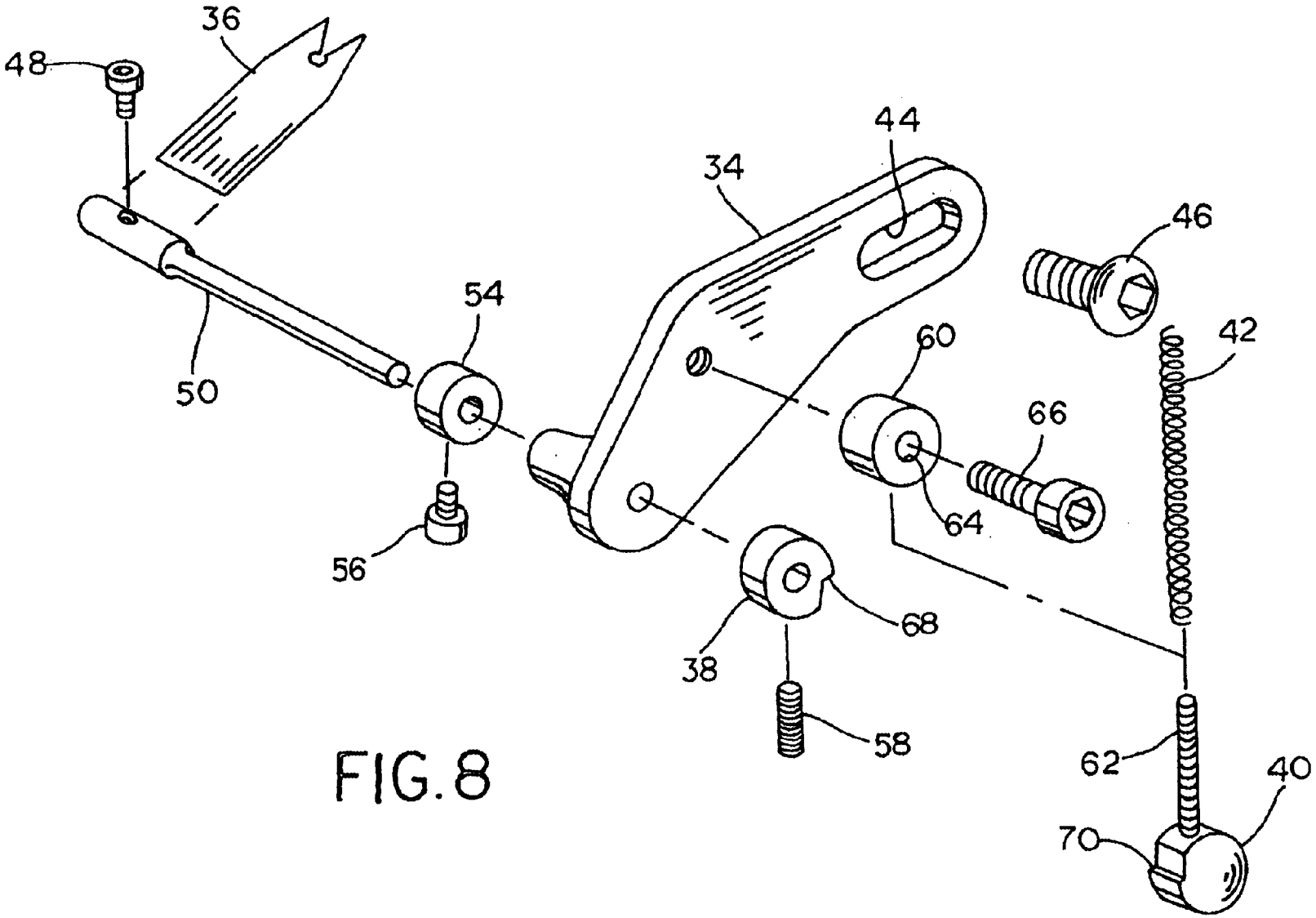
FIG. 8 is an exploded, perspective view of the arrow rest shown in FIGS. 1–7.

Referring now to FIGS. 1–7, a method of shooting archery bow 10 will be described hereinafter. If arrow rest platform 36 is already in the lowered position, then a user simply presses against set screw 58 with a thumb or finger to rotate arrow rest platform 36 to a raised support position. When arrow rest platform 36 is moved to the raised support position, first sear 38 and second sear 40 engage with each other at shoulders 68, 70 (FIGS. 4 and 6). Nock 24 of arrow 22 is then nocked onto string 20 at arrow nock location 26 within the confines of nock set 28. Arrow 22 is then placed on the raised arrow rest platform 36 (FIG. 1). Hand release 30 is engaged with nock set 28 so that bow 10 may be drawn to a fire position (FIG. 2). Hand release 30 is then activated so that string 20 is released. This results in forward motion of string 20 with which arrow 22 is engaged, and simultaneously results in return flexure of limbs 16 as arrow 22 moves along trajectory path 32. The forward motion of string 20 and return flexure of limbs 16 causes an impulse to be applied to second sear 40 in a direction generally along trajectory path 32. This impulse causes pendulum arm 62 to swing forward in a direction generally corresponding to trajectory path 32, which in turn results in disengagement between shoulders 68 and 70 of first sear 38 and second sear 40. Upon disengagement between first sear 38 and second sear 40, spring 42 rotates first sear 38, pivot arm 50 and arrow rest platform 36 to the lowered position (FIGS. 3, 6 and 7). If bow 10 is properly gauged and set up prior to shooting, then arrow 22 should be moving along trajectory path 32 at a generally right angle orientation relative to string 20 when string 20 is at a rest position. Thus, the only forces which should be applied to arrow 22 are generally in an axial direction of arrow 22 along trajectory path 32. When arrow rest platform 36 moves to the lowered position upon release of hand release 30, arrow rest platform 36 is entirely out of the flight path of arrow 22 and fletchings 72 so as to not interfere with the free flight of arrow 22.

In the embodiment shown, resilient biasing device 42 is in the form of a tension spring which partially wraps first sear 38 and thus causes rotation of first sear 38 upon disengagement between first sear 38 and second sear 40. It will be appreciated that the spring characteristics of spring 42 may be varied to adjust the rate at which arrow rest platform 36 may be moved to the lowered position upon disengagement between first sear 38 and second sear 40. Likewise, the attachment location at either end of spring 42 may vary the applied forces at the periphery of first sear 38 and in turn vary the rotational acceleration of first sear 38 upon disengagement with second sear 40.

Moreover, in the embodiment shown, second sear 40 is disengaged from first sear 38 using a rotary actuator including pendulum arm 62 and hub 60, as described above. Depending upon the application, it may also be desirable to configure the actuator for disengaging second sear 40 and/or first sear 38 using a generally linear actuator. For example, it may be possible to form support body 34 with a larger flange extending in a downward direction under adjustable slot 44 and slidably couple second sear 40 in an adjustment slot. Configured as such, second sear 40 may be biased to an engaged position with first sear 38 using a compression spring acting between second sear 40 and a fixed surface extending from support body 34. Other configurations are also possible, the primary criteria being that first sear 38 and second sear 40 disengage upon application of an impulse in a direction generally along trajectory path 32.

By configuring first sear 38 and second sear 40 such that they disengage upon application of an impulse along trajectory path 32, the present invention avoids unintentional disengagement upon application of bumps or jars to bow 10 in other directions, such as may occur if the side of riser 14 is bumped, a distal end of a limb 16 is bumped, etc. The present invention therefore provides selective disengagement only when an impulse along trajectory path 32 is received by bow 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An archery bow, comprising:

a riser;

a pair of flexible limbs extending oppositely from said riser, each said limb having a distal end;

an arrow rest mounted to said riser and defining a trajectory path for an arrow, said arrow rest including:

an arrow rest platform;

a first sear associated with said arrow rest platform;

a second sear selectively engageable with said first sear, and automatically disengageable with said first sear upon application of an impulse in a direction generally parallel to said trajectory path;

a spring for biasing said first sear and said second sear to an engaged position, said arrow rest platform being in a raised support position when said first sear and said second sear are in the engaged position; and a pendulum arm with a distal end carrying said second sear, and wherein said spring is connected at one end with said pendulum arm and at an other end with said first sear.

2. The archery bow of claim 1, including an actuator which disengages said second sear from said first sear upon application of said impulse.

3. The archery bow of claim 2, wherein said actuator comprises one of a rotary actuator and a linear actuator.

4. The archery bow of claim 2, wherein said actuator comprises a rotary actuator including a pendulum arm with a distal end carrying said second sear.

5. An arrow rest platform for use with an archery bow, comprising:

an arrow rest platform defining a trajectory path for an arrow;

a first sear associated with said arrow rest platform;

a second sear selectively engageable with said first sear, and automatically disengageable with said first sear upon application of an impulse in a direction generally parallel to said trajectory path;

a spring for biasing said first sear and said second sear to an engaged position, said arrow rest platform being in a raised support position when said first sear and said second sear are in the engaged position; and a pendulum arm with a distal end carrying said second sear, and wherein said spring is connected at one end with said pendulum arm and at an other end with said first sear.

6. The arrow rest of claim 5, including an actuator which disengages said second sear from said first sear upon application of said impulse.

7. The arrow rest of claim 6, wherein said actuator comprises one of a rotary actuator and a linear actuator.

8. The arrow rest of claim 6, wherein said actuator comprises a rotary actuator including a pendulum arm with a distal end carrying said second sear.

* * * * *